United States Patent [19]

Sudnishnikov et al.

[11] Patent Number: 4,862,972

[45] Date of Patent: Sep. 5, 1989

[54] SINGLE-BLOW PNEUMATIC PERCUSSIVE TOOL

[76] Inventors: Vadim B. Sudnishnikov, Krasny prospekt, 56, kv. 59; Andrei A. Zelentsov, ulitsa Sverdlova, 11, kv. 1, both of Novosibirsk, U.S.S.R.

[21] Appl. No.: 265,873

[22] PCT Filed: Dec. 15, 1986

[86] PCT No.: PCT/SU86/00126

§ 371 Date: Aug. 12, 1988

§ 102(e) Date: Aug. 12, 1988

[87] PCT Pub. No.: WO88/04598

PCT Pub. Date: Jun. 30, 1988

[51] Int. Cl.[4] ..... B21J 7/26

[52] U.S. Cl. ..... 173/121; 173/134; 173/169; 91/47

[58] Field of Search ..... 173/90, 121, 134, 136, 173/168–170; 91/47

[56] References Cited

U.S. PATENT DOCUMENTS

| | | | |
|---|---|---|---|
| 3,111,997 | 11/1963 | Krembel, Jr. | 173/121 X |
| 3,273,657 | 9/1966 | Willems et al. | 173/121 |
| 3,851,713 | 12/1974 | Fedosenko et al. | 173/121 |

FOREIGN PATENT DOCUMENTS

| | | |
|---|---|---|
| 294935 | 3/1971 | U.S.S.R. . |
| 664831 | 5/1979 | U.S.S.R. . |
| 706239 | 12/1979 | U.S.S.R. . |
| 764970 | 9/1980 | U.S.S.R. . |
| 1027026 | 7/1983 | U.S.S.R. . |
| 1463412 | 2/1977 | United Kingdom . |

*Primary Examiner*—Frank T. Yost
*Assistant Examiner*—James L. Wolfe
*Attorney, Agent, or Firm*—Lilling & Greenspan

[57] ABSTRACT

A single-blow pneumatic percussive tool includes a hollow cylindrical casing (1) having inlet and outlet ports (2, 3). A hammer piston (4) mounted in the casing (1) divides the interior space of the casing (1) into lower and upper chambers (5,6). A working tool (7) is mounted in the casing (1) on the side of the lower chamber (5). A handle (9) having passages and an air distribution device (8) is mounted in the upper part of the casing (1). A sleeve (12) with ports (13) is mounted on the casing (1) to define a space (14) therewith. An air distribution sleeve (15) is axially biased by a spring mounted in the space (14). The outlet ports (3) of the casing (1) are aligned with the ports (13) of the sleeve (12). The air distribution sleeve (15) has radial ports and recesses (17) which are aligned with the radial ports (16) on both surfaces of the air distribution sleeve (15). At least one passage (18) is made in the hammer piston (47) which is biased by spring on the side of the lower chamber (5).

4 Claims, 2 Drawing Sheets

SINGLE-BLOW PNEUMATIC PERCUSSIVE TOOL

BACKGROUND OF THE INVENTION

1. Field of the Invention

The invention relates to pneumatic percussive tools used in the construction and mining industries, mechanical engineering and metallurgy, and more specifically, it deals with single-blow pneumatic percussive tools.

2. Description of the Prior Art

Pneumatic percussive tools, in particular, pneumatic hammers are used for marking, center-popping, riveting, marking-out and gate trimming. Depending on a specific application, the pneumatic hammer has a working tool such as a stamp, center punch or chisel. The working tool is mounted in a casing having an interior space and inlet and outlet ports. The interior space of the casing accmmodates a hammer piston defining working chambers in the interior space. An energy carrier is gaseous fluid under pressure which is supplied to the tool from a portable or stationary compressor along a flexible hose. During operation of the tool, the hammer piston axially reciprocates under the action of compressed air alternately admitted to the working chambers through the air distribution device to impart a blow to the end face of the working tool at every working cycle. The working tool performs work under the action of blows whereby, depending on the type of the working tool, marking, center-popping, trimming or riveting takes place.

Since operations performed using such tools are effected with the direct participation of the operator, stringent requirements are imposed upon their reliability (durability) and operating conditions.

Known in the art is a single-blow pneumatic percussive tool (cf. USSR Inventor's Certificate No. 706239, Int.Cl. B 25 D 9/04), comprising a hollow cylindrical casing having inlet and outlet ports accommodating a hammer piston having an opening and dividing the interior space of the casing into upper and lower chambers, and a spring-biased working tool having a head in the form of a valve mounted on the side of the lower chamber for establishing communication thereof with atmosphere when the hammer piston moves downwards.

For starting the tool, i.e. for causing the hammer piston to move down, it is necessary that the lower chamber communicate with atmosphere. In this tool such communication is possible when the working tool is pressed against the workpiece surface so that the head in the form of a valve provides for communication of the lower chamber with atmosphere. However, big effort is needed on the part of the operator for starting the tool so that operating conditions are complicated and impact energy decreases.

Known in the art is a single-blow pneumatic percussive tool (cf. USSR Inventor's Certificate No. 1027026, Int. Cl. B 25 D 9/04, comprising a hollow cylindrical casing having inlet and outlet ports and accommodating a hammer piston which divides the interior space of the casing into upper and lower working chambers, a working tool, a sleeve with ports mounted in the casing for movement relative thereto, and a starting device in the form of a spring-biased valve mounted on the side of the lower chamber.

The lower chamber should communicate with atmosphere to effect the hammer piston movement downwards. In this tool, this is achieved by pressing against the working tool so that the latter is caused to move until it bears against the sleeve. However, in orer to move the sleeve to such an extent that the lower chamber might communicate with atmosphere through the sleeve ports and the tool might be started, the force applied to the working tool must be great enough. Since the tool is started by the operator, great forces should be applied thus complicating operating conditions and lowering impact energy of the tool.

SUMMARY OF THE INVENTION

The main object of the present invention is to provide a single-blow pneumatic percussive tool in which impact energy of a single blow is increased by modifying direction of flow of gaseous fluid under pressure in the interior space of the casing.

The invention substantially resides in a single-blow pneumatic percussive tool comprising a hollow cylindrical casing with inlet and outlet ports accommodating a reciprocatable hammer piston which divides the interior space of the casing into lower and upper chambers, a working tool mounted in the casing on the side of the lower chamber, an air distribution device mounted in a handle installed on the upper part of the casing and having passages for admission of gaseous fluid under pressure to the interior space of the casing, a sleeve with ports defining with the casing and intermediate space which communicates at regular intervals with the lower chamber through the outlet ports for admission of gaseous fluid under pressure. According to the invention the tool comprises an air distribution sleeve which is axially biased by a spring and has radial ports and recesses aligned with the radial ports on both surfaces of the air distribution sleeve which is mounted for reciprocations in the intermediate space alternately communicating with one passage for admission of gaseous fluid under pressure and with atmosphere, and the outlet ports of the casing are aligned with the ports of a sleeve rigidly mounted outside the casing, the outlet ports being covered by the sleeve when the air distribution sleeve is in the upper position and establish communication of the lower chamber with atmosphere through the radial ports when the air distribution sleeve is in the lower position, the lower and upper chambers communicating with each other through at least one passage made in the hammer piston which is biased by a spring on the side of the lower chamber.

This construction of the tool makes it possible to increase impact energy owing to the maximum possible speed of evacuation of the lower chamber from gaseous fluid under pressure and to improve operating conditions of the tool because only a slight force should be applied for starting the tool.

The outlet ports of the casing are preferably made in the form of transverse slits.

This arrangement of the outlet ports of the casing makes it possible to increase impact energy of the tool owing to the maximum possible speed of their opening which minimizes the opening time.

The grooves of the air distrubution sleeve are preferably of a width which is greater than the width of the outlet ports.

This arrangement of the grooves makes it possible to increase impact energy of the tool owing to full opening of the outlet ports and, respectively, rapid evacuation of the lower chamber from gaseous fluid under pressure during the workstroke of the hammer piston.

The air distribution sleeve is preferably provided with a retainer for retaining it in the uppermost position, the sleeve being subsequently releasable under the action of gaseous fluid.

BRIEF DESCRIPTION OF THE DRAWINGS

The invention will now be described with reference to a specific embodiment shown in the accompanying drawings, in which.

DESCRIPTION OF THE PREFERRED EMBODIMENT

Figures 1, 3:
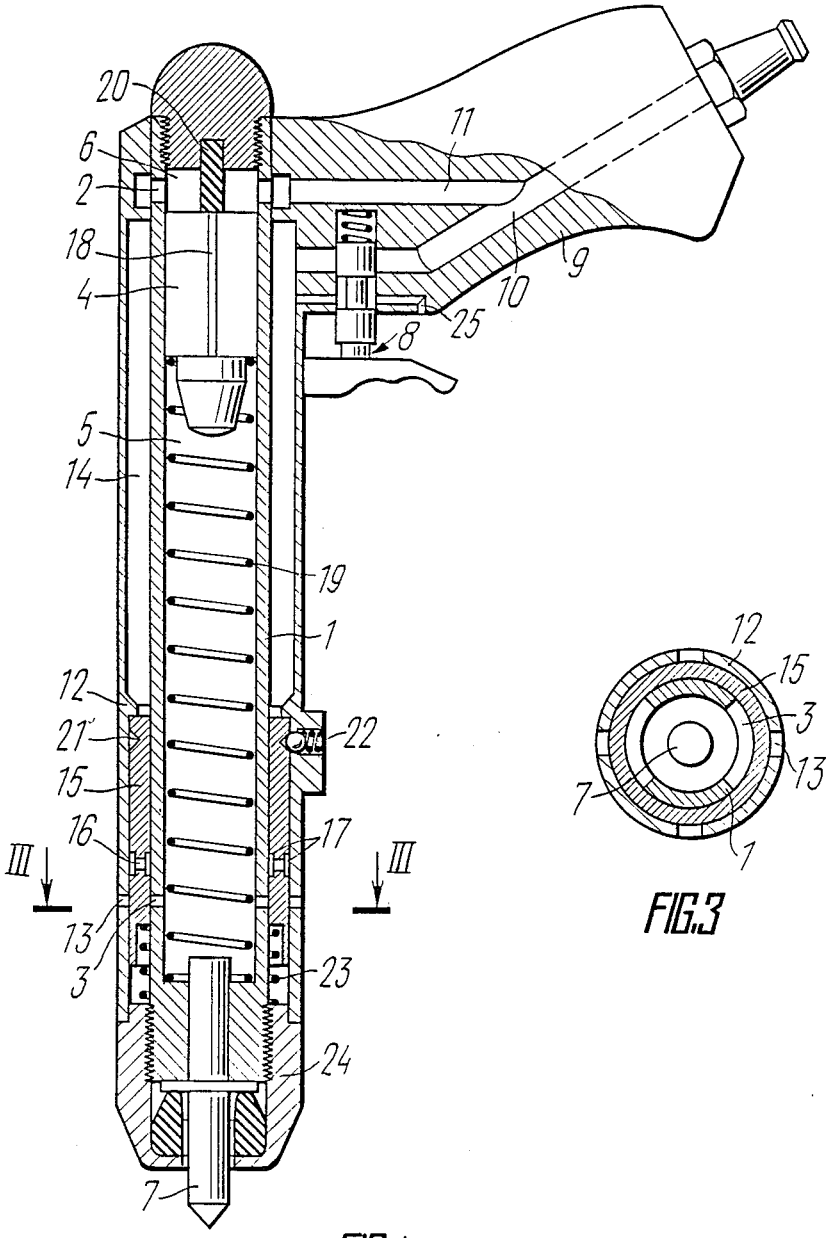
FIG. 1 schematically shows a single-blow pneumatic percussive tool according to the invention during the return stroke of the hammer piston, in longitudinal section.
FIG. 3 is a sectional view taken along line III—III in FIG. 1.
Figure 2:
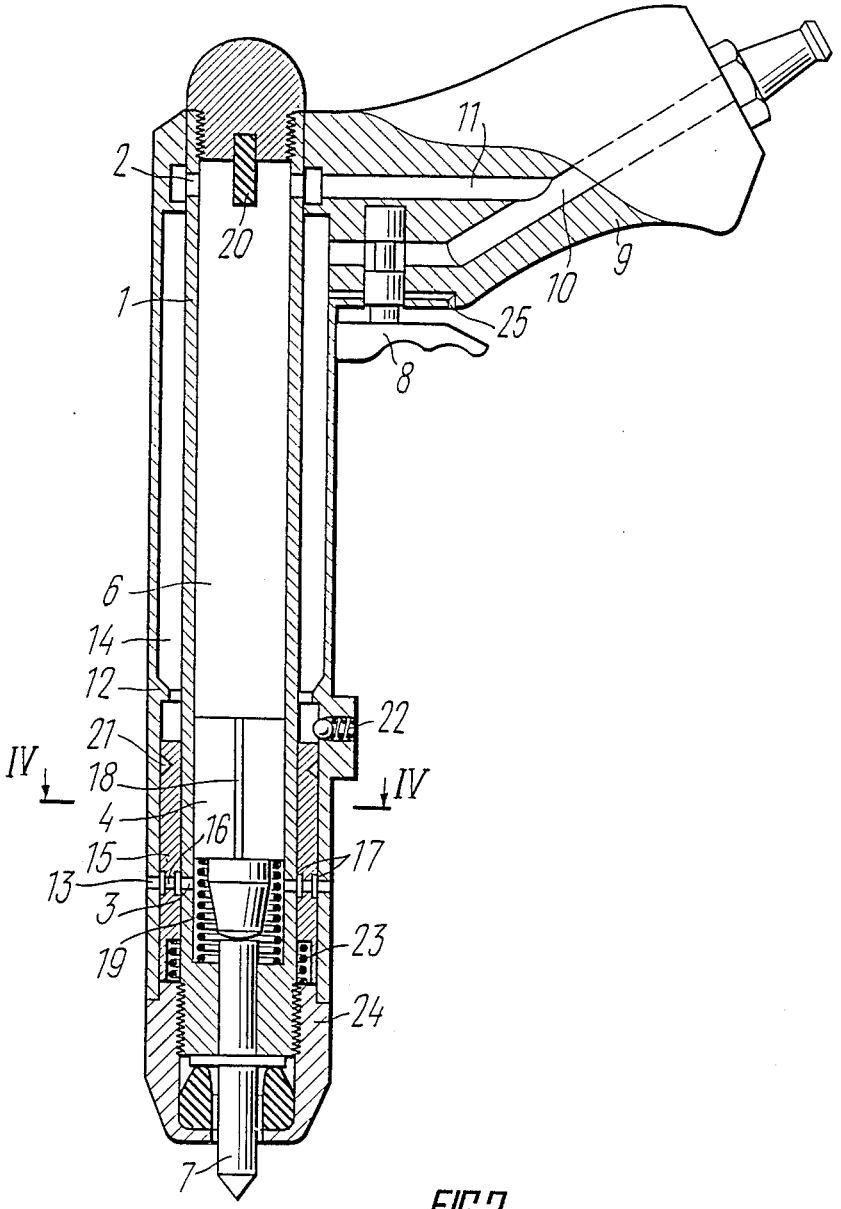
FIG. 2 shows a single-blow pneumatic percussive tool at the moment when the hammer piston imparts a blow to the working tool, in longitudinal section.

A single-blow pneumatic percussive tool shown in FIGS. 1, 2 comprises a hollow cylindrical casing 1 having inlet ports 2 and outlet ports 3 accommodating a reciprocatable hammer piston 4 which divides the interior space of the casing 1 into a lower chamber 5 and an upper chamber 6. A working tool 7 is mounted in the casing 1 on the side of the lower chamber 5. A handle 9 is mounted in the upper part of the casing 1 and accommodates an air distribution device 8 and has passages 10, 11 for the admission of gaseous fluid under pressure to the interior space of the casing 1. A sleeve 12 is rigidly mounted on the casing 1 and has ports 13, the sleeve defining with the casing 1 an intermediate space 14 in which an air distribution sleeve 15 is mounted for reciprocation, the air distribution sleeve being axially biased by a spring and having radial ports 16 and recesses 17. The outlet ports 3 of the casing 1 are aligned with the ports 13 of the sleeve 12. The recesses 17 are aligned with the radial ports 16 on both surfaces of the air distribution sleeve 15. The width of the recess 17 is greater than the width of the outlet ports 3. The hammmer piston 4 has one passage 18 for establishing communication between the lower chamber 5 and upper chamber 6. In another embodiment there may be two, three and even more passages in the hammer piston. Moreover, a spring 19 is mounted in the interior space of the casing 1 for cooperation with the hammer piston 4 on the side of the lower chamber 5, and a shock-absorber 20 engageable with the hammer piston 4 is provided on the side of the upper chamber 6. A groove 21 is made in the air distribution sleeve 15 for cooperation with a ball retainer 22 for retaining the air distribution sleeve 15 in the upper position and for its subsequent release under the action of gaseous fluid in the intermediate space 14. The casing 1, on the side of the lower chamber, accommodates a spring 23 cooperating with the air distribution sleeve 15 and a cover 24 for retaining the working tool 7 in the casing 1. The handle 9 has a passage 25 for communicating the intermediate space 14 with atmosphere.

The single-blow pneumatic percussive tool functions in the following manner.

Gaseous fluid under pressure is admitted through a socket pipe of the handle 9 (FIG. 1), passage 11 and inlet ports 2 to the upper chamber 6 and, via the passage 18 of the hammer piston 4, to the lower chamber 5. The air distribution sleeve 15 is in the uppermost position under the action of the spring 23, and the intermediate space 14 communicates with atmosphere through the air distribution device 8 and passage 25 while the hammer piston 4 is held in the uppermost position by the spring 19, the position of the hammer piston being defined by the shock-absorber 20. When the air distribution device 8 is moved to the uppermost position (FIG. 2), the passage 25 is shut-off, and gaseous fluid under pressure is admitted through the passage 10 and air distribution device 8 to the intermediate space 14 to act upon the end face of the air distribution sleeve 15 which is retained by engagement of the groove 21 and ball retainer 22. As soon as pressure in the intermediate space 14 reaches a preset value, the air distribution sleeve 15 is released and it will move under the action of gaseous fluid under pressure towards the lowermost position defined by the cover 24 to compress the spring 23. The lower chamber 5 communicates with atmosphere through the outlet ports 3, recesses 17, radial ports 16 and ports 13 which are in registry with one another, and gaseous fluid under pressure will be abruptly discharged from the lower chamber into atmosphere. The width of the recesses 17 is greater than the width of the outlet ports 3 because otherwise inadequate discharge of gaseous fluid under pressure from the lower chamber would result in the formation of a cushion in the lower chamber 5 during the workstroke of the hammer pistion 4 thus lowering impact energy. Owing to a pressure difference between the lower and upper chambers 5 and 6, the hammer piston 4 will move under the action of gaseous fluid under pressure on the side of the upper chamber 6 to compress the spring 19 towards the lowermost position and to impart at the end of travel a blow to the working tool 7 which is in engagement with the workpiece surface to perform useful work.

After the admission of gaseous fluid under pressure to the intermediate space 14 is interrupted (FIG. 1) the latter will connect to atmosphere through the air distribution device 8 and passage 25, and the air distribution sleeve 15 will move towards the upper position under the action of the spring 23. As soon as the air distribution sleeve 15 covers with its wall the outlet ports 3, pressure in the lower chamber 5 will become equal to pressure in the upper chamber 6 owing to the passage 18 of the hammer piston 4, and the hammer piston will be moved by the spring 19 to the uppermost position defined by the shock-absorber 20. The air distribution sleeve 15 will move to the uppermost position and will be retained in this position by means of the groove 21 and ball retainer 22.

In comparison with prior art types of single-blow pneumatic percussive tools, the tool according to the invention makes it possible to effect an abrupt discharge of gaseous fluid under pressure from the lower chamber and ensures a low force for starting the tool.

These advantages result in an increase of impact energy by 7–10% and improve labour conditions.

The invention may be most advantageously used in tools designed for marking, center-popping, riveting, marking-out and gate trimming.

The invention may also be used in apparatuses for mining working roof trimming, for demolishing concrete, making holes and performing other operations in the construction industry.

We claim:

1. A single-blow pneumatic percussive tool comprising a hollow cylindrical casing (1) with inlet and outlet ports (2, 3) accommodating a reciprocatable hammer piston (4) which divides the interior space of the casing (1) into lower and upper chambers (5, 6), a working tool (7) mounted in the casing (1) on the side of the lower chamber (5) an air distribution device (8) mounted in a handle (9) installed on the upper part of the casing (1) and having passages (10, 11) for admission of gaseous fluid under pressure to the interior space of the casing (1), a sleeve (12) with ports (13) defining with the casing (1) an intermediate space (14) which communicates at regular intervals with the lower chamber (5) through the outlet ports (3) for admission of gaseous fluid under pressure an air distribution sleeve (15) which is axially biased by a spring; and has radial ports (16) and recesses (17) aligned with the radial ports (16) on both surfaces of the air distribution sleeve (15) which is mounted for reciprocations in the intermediate space (14) alternately communicating with one passage (10) for admission of gaseous fluid under pressure and with atmosphere, and the outlet ports (3) of the casing (1) are aligned with the ports (13) of the sleeve (12) rigidly mounted outside the casing (1) the outlet ports (3) being covered by the sleeve (15) when the air distribution sleeve (15) is in the upper position and establish communication of the lower chamber (5) with atmosphere through the radial ports (16) when the air distribution sleeve (15) is in the lower position, the lower and upper chambers (5,6) communicating with each other through at least one passage (18) made in the hammer piston (4) which is biased by a spring on the side of the lower chamber (5).

2. A tool according to claim 1, wherein the outlet ports (3) of the casing (1) are in the form of transverse slits, 3. A tool according to claim 1, wherein the recesses of the air distribution sleeve (15) are of a width which is greater than the width of the outlet ports (3).

4. A tool according to claim 1, wherein the air distribution sleeve (15) is provided with a retainer (22) for retaining the sleeve in the uppermost position for subsequent release thereof under the action of gaseous fluid.

* * * * *